US011462145B2

(12) United States Patent
Lee et al.

(10) Patent No.: US 11,462,145 B2
(45) Date of Patent: Oct. 4, 2022

(54) DISPLAY APPARATUS AND METHOD OF DRIVING DISPLAY PANEL USING THE SAME

(71) Applicant: Samsung Display Co., Ltd., Yongin-Si (KR)

(72) Inventors: Suk Hun Lee, Suwon-si (KR); Sangan Kwon, Cheonan-si (KR); Hong Soo Kim, Hwaseong-si (KR); Jin Young Roh, Hwaseong-si (KR); Sehyuk Park, Seongnam-si (KR); Hyo Jin Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/992,011

(22) Filed: Aug. 12, 2020

(65) Prior Publication Data

US 2021/0097924 A1 Apr. 1, 2021

(30) Foreign Application Priority Data

Sep. 30, 2019 (KR) ..... 10-2019-0120866

(51) Int. Cl.
*G09G 3/20* (2006.01)

(52) U.S. Cl.
CPC ..... *G09G 3/2007* (2013.01); *G09G 2310/027* (2013.01); *G09G 2310/08* (2013.01); *G09G 2320/0247* (2013.01); *G09G 2320/0606* (2013.01); *G09G 2320/08* (2013.01); *G09G 2320/10* (2013.01); *G09G 2360/144* (2013.01)

(58) Field of Classification Search
CPC ..... G09G 2310/027; G09G 2310/08; G09G 2320/0247; G09G 2320/0606; G09G 2320/08; G09G 2320/10; G09G 2340/0435; G09G 2360/144; G09G 2360/16; G09G 3/20; G09G 3/2007
See application file for complete search history.

(56) References Cited

U.S. PATENT DOCUMENTS

2016/0078815 A1* 3/2016 Nebon ..... G09G 3/3258 345/76
2017/0018234 A1* 1/2017 Na ..... G09G 3/3406

FOREIGN PATENT DOCUMENTS

KR 10-2008-0098097 A 11/2008
KR 10-2016-0044166 A 4/2016
KR 10-2016-0053377 A 5/2016

* cited by examiner

*Primary Examiner* — Kenneth Bukowski
(74) *Attorney, Agent, or Firm* — Innovation Counsel LLP

(57) ABSTRACT

A display apparatus includes a display panel displaying an image based on an input image data, a data driver outputting a data voltage to a data line, and a driving controller determining a driving frequency of the display panel based on the input image data. The driving controller includes a flicker value storage configured to store flicker values for grayscale values corresponding to the input image data, a voltage drop determiner configured to adjust a flicker value of the flicker values based on a voltage drop of the display panel, a still image determiner configured to determine whether the input image data is a still image or a video image, and a driving frequency determiner configured to determine the driving frequency of the display panel using the flicker value based on the input image data being the still image.

22 Claims, 10 Drawing Sheets

FIG. 4

| STAGE | INPUT GRAYSCALE(8bit) | FLICKER VALUE | FREQUENCY(Hz) |
|---|---|---|---|
| 1 | 0-3 | 0 | 1 |
| 2 | 4-7 | 0 | 1 |
| 3 | 8-11 | 40 | 2 |
| 4 | 12-15 | 80 | 5 |
| 5 | 16-19 | 120 | 10 |
| 6 | 20-23 | 160 | 30 |
| 7 | 24-27 | 200 | 60 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

FIG. 5

| STAGE | INPUT GRAYSCALE(8bit) | FLICKER VALUE | FREQUENCY(Hz) |
|---|---|---|---|
| 1 | 0-3 | 0 | 1 |
| 2 | 4-7 | 0 | 1 |
| 3 | 8-11 | 0 | 1 |
| 4 | 12-15 | 40 | 2 |
| 5 | 16-19 | 80 | 5 |
| 6 | 20-23 | 120 | 10 |
| 7 | 24-27 | 160 | 30 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

FIG. 6

| STAGE | INPUT GRAYSCALE(8bit) | FLICKER VALUE | FREQUENCY(Hz) |
|---|---|---|---|
| 1 | 0-3 | 0 | 1 |
| 2 | 4-7 | 0 | 1 |
| 3 | 8-11 | 0 | 1 |
| 4 | 12-15 | 0 | 1 |
| 5 | 16-19 | 40 | 2 |
| 6 | 20-23 | 80 | 5 |
| 7 | 24-27 | 120 | 10 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

| | | | | |
|---|---|---|---|---|
| SEG11 | SEG12 | SEG13 | SEG14 | SEG15 |
| SEG21 | SEG22 | SEG23 | SEG24 | SEG25 |
| SEG31 | SEG32 | SEG33 | SEG34 | SEG35 |
| SEG41 | SEG42 | SEG43 | SEG44 | SEG45 |
| SEG51 | SEG52 | SEG53 | SEG54 | SEG55 |
| SEG61 | SEG62 | SEG63 | SEG64 | SEG65 |
| SEG71 | SEG72 | SEG73 | SEG74 | SEG75 |
| SEG81 | SEG82 | SEG83 | SEG84 | SEG85 |

100

DISPLAY APPARATUS AND METHOD OF DRIVING DISPLAY PANEL USING THE SAME

PRIORITY STATEMENT

This application claims priority under 35 U.S.C. § 119 to Korean Patent Application No. 10-2019-0120866, filed on Sep. 30, 2019 in the Korean Intellectual Property Office KIPO, the contents of which are herein incorporated by reference in their entireties.

BACKGROUND

1. Field

Example embodiments of the present inventive concept relate to a display apparatus and a method of driving a display panel using the display apparatus. More particularly, example embodiments of the present inventive concept relate to a display apparatus reducing power consumption and enhancing a display quality and a method of driving a display panel using the display apparatus.

2. Description of the Related Art

Recent research focus has been on minimizing power consumption of an electronic device, particularly a mobile device such as a tablet personal computer (PC) and a notebook PC.

To minimize power consumption of an electronic device including a display panel, power consumption of the display panel would need to be minimized as well. When the display panel displays a still image, the display panel may be driven at a low frequency mode so that power consumption of the display panel can be reduced.

However, driving the display panel at a relatively low frequency mode may cause image flicker resulting in a poor display quality. Especially, image flickering may become a more serious issue at a portion (e.g., a lower portion) of the display panel that is farther from a data driver due to a voltage drop of a driving voltage or a data voltage over a data line.

SUMMARY

Example embodiments of the present inventive concept provide a display apparatus capable of reducing power consumption and enhancing a display quality.

Example embodiments of the present inventive concept also provide a method of driving a display panel using the display apparatus.

In an example embodiment of a display apparatus according to the present inventive concept, the display apparatus includes a display panel, a data driver, and a driving controller. The display panel includes a data line and a pixel connected to the data line. The display panel is configured to display an image based on an input image data. The data driver is configured to output a data voltage to the data line. The driving controller is configured to control an operation of the data driver and to determine a driving frequency of the display panel based on the input image data. The driving controller includes a flicker value storage configured to store flicker values for grayscale values corresponding to the input image data, a voltage drop determiner configured to adjust a flicker value of the flicker values based on a voltage drop of the display panel, a still image determiner configured to determine whether the input image data is a still image or a video image, and a driving frequency determiner configured to determine the driving frequency of the display panel using the flicker value based on the input image data being the still image.

In an example embodiment, the voltage drop determiner may be configured to determine a just-noticeable difference of a user according to the voltage drop of the display panel. The flicker value may be adjusted according to the just-noticeable difference.

In an example embodiment, the flicker value storage may include a plurality of flicker lookup tables. The voltage drop determiner determines that a reference just-noticeable difference corresponds to a first just-noticeable difference according to the voltage drop of the display panel, and the driving frequency determiner may be configured to determine the driving frequency using a first flicker lookup table corresponding to the first just-noticeable difference. The voltage drop determiner determines that the reference just-noticeable difference corresponds to a second just-noticeable difference according to the voltage drop of the display panel, and the driving frequency determiner may be configured to determine the driving frequency using a second flicker lookup table corresponding to the second just-noticeable difference.

In an example embodiment, the voltage drop determiner may be configured to set a reference just-noticeable difference based on the voltage drop. A size of a low driving grayscale range may be determined based on the just-noticeable difference.

In an example embodiment, the voltage drop determiner may determine the voltage drop by sensing a current flowing through the pixel or a current flowing through the data line.

In an example embodiment, the display apparatus may further include an ambient light determiner configured to adjust the flicker value based on an intensity of an ambient light.

In an example embodiment, the ambient light determiner may be configured to determine a just-noticeable difference of a user according to the intensity of the ambient light. The flicker value may be adjusted according to the just-noticeable difference.

In an example embodiment, the ambient light determiner may be configured to set a reference just-noticeable difference based on the intensity of the ambient light. A size of a low driving grayscale range may be determined based on the just-noticeable difference.

In an example embodiment, the display apparatus may further include a user luminance setter configured to adjust the flicker value based on a user luminance setting value set by a user.

In an example embodiment, the user luminance setter may be configured to determine a just-noticeable difference of the user according to the user luminance setting value. The flicker value may be adjusted according to the just-noticeable difference.

In an example embodiment, the user luminance setter may be configured to set a reference just-noticeable difference based on the user luminance setting value. A size of a low driving grayscale range may be determined based on the just-noticeable difference.

In an example embodiment, the driving controller may further include a fixed frequency determiner configured to determine a type of an input frequency of the input image data by counting a number of pulses of a horizontal synchronizing signal between a first pulse and a second pulse of a vertical synchronizing signal or by counting a number of pulses of a data enable signal between the first pulse and the second pulse of the vertical synchronizing signal.

In an example embodiment, the fixed frequency determiner may be configured to generate a frequency flag indicating the type of the input frequency of the input image data. The driving frequency determiner may be configured to determine the driving frequency of the display panel based on the frequency flag.

In an example embodiment, the display panel may include a plurality of segments. The driving controller may be configured to determine the driving frequency of the display panel based on the plurality of segments.

In an example embodiment, the display apparatus may further include a driving mode setter configured to adjust the flicker value based on a luminance of a display image according to a driving mode.

In an example embodiment, the driving mode setter may be configured to determine a just-noticeable difference of a user according to the driving mode. The flicker value may be adjusted according to the just-noticeable difference.

In an example embodiment, the driving mode setter may be configured to set a reference just-noticeable difference based on the luminance of the display image according to the driving mode. A size of a low driving grayscale range may be determined based on the just-noticeable difference.

In an example embodiment of a method of driving a display panel, the method includes determining whether an input image data is a still image or a video image, determining a driving frequency of the display panel using a flicker value storage that stores flicker values for grayscale values corresponding to the input image data based on the input image data being the still image, and outputting a data voltage to a data line of the display panel based on the driving frequency. The flicker value is adjusted based on a voltage drop of the display panel.

In an example embodiment, the flicker value may be adjusted according to a just-noticeable difference of a user and the voltage drop of the display panel.

In an example embodiment, the flicker value storage may include a plurality of flicker lookup tables. A reference just-noticeable difference is determined to correspond to a first just-noticeable difference according to the voltage drop of the display panel, and the driving frequency may be determined using a first flicker lookup table corresponding to the first just-noticeable difference. The reference just-noticeable difference is determined to correspond to a second just-noticeable difference according to the voltage drop of the display panel, and the driving frequency may be determined using a second flicker lookup table corresponding to the second just-noticeable difference.

In an example embodiment, a reference just-noticeable difference may be set based on the voltage drop. A size of a low driving grayscale range may be determined based on the just-noticeable difference.

In an example embodiment, the voltage drop may be determined by sensing a current flowing through the pixel or a current flowing through the data line.

In an example embodiment, the flicker value may be adjusted based on an intensity of an ambient light or a user luminance setting value.

According to the display apparatus and the method of driving the display panel using the display apparatus, the driving frequency is determined according to an image displayed on the display panel to reduce power consumption of the display apparatus. In addition, the driving frequency is determined using a flicker value of the image on the display panel to prevent a flicker of the image and enhance a display quality of the display panel. In addition, the display apparatus may include a voltage drop determiner for adjusting the flicker value based on the voltage drop of the display panel.

BRIEF DESCRIPTION OF THE DRAWINGS

The above and other features and advantages of the present inventive concept will become more apparent by describing in detailed example embodiments thereof with reference to the accompanying drawings, in which:

FIG. 4 is a table of an exemplary flicker value storage of FIG. 2;

FIG. 5 is a table of an exemplary flicker value storage of FIG. 2;

FIG. 6 is a table of an exemplary flicker value storage of FIG. 2;

DETAILED DESCRIPTION OF THE INVENTIVE CONCEPT

Hereinafter, the present inventive concept will be explained in detail with reference to the accompanying drawings.

Figure 1:
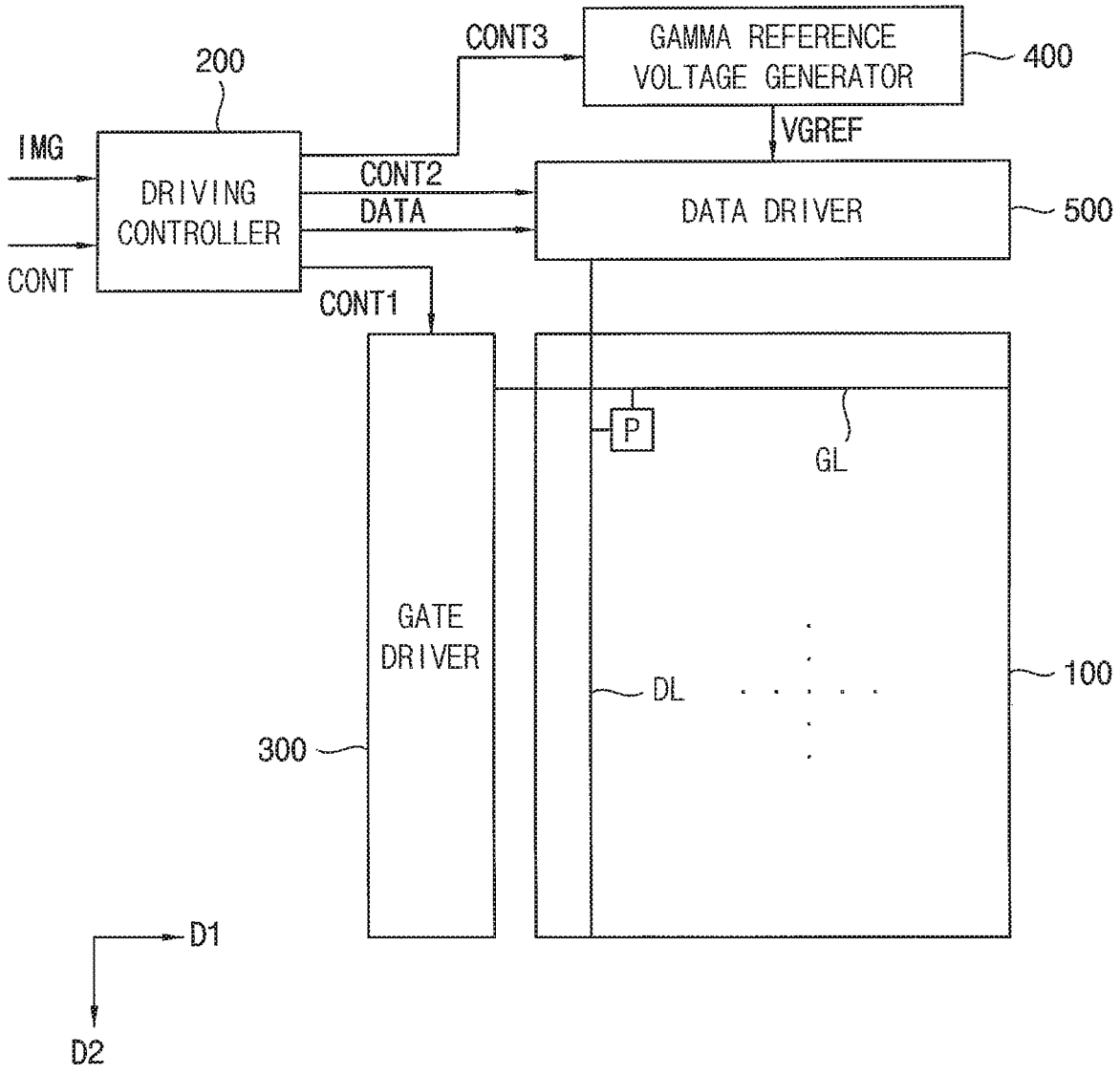
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400, and a data driver 500.

In one embodiment, the driving controller 200 and the data driver 500 may be integrally formed, and the driving controller 200, the gamma reference voltage generator 400, and the data driver 500 may be integrally formed. A driving module that integrally includes at least the driving controller 200 and the data driver 500 may be referred to as a timing controller embedded data driver (TED).

The display panel 100 includes a plurality of gate lines GL, a plurality of data lines DL, and a plurality of pixels P connected to the gate lines GL and the data lines DL. The gate lines GL may extend in a first direction D1, and the data lines DL may extend in a second direction D2 crossing the first direction D1.

The driving controller 200 may receive input image data IMG and an input control signal CONT from an external apparatus (not shown). In one embodiment, the input image data IMG may include red image data, green image data, and blue image data. In another embodiment, the input image data IMG may include white image data. In another embodiment, the input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

In one embodiment, the driving controller 200 may adjust a driving frequency of the display panel 100 based on the input image data IMG.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 are explained with reference to FIGS. 2 to 6 in further detail.

The gate driver 300 generates gate signals in response to the first control signal CONT1 that is received from the driving controller 200. The gate driver 300 outputs the gate signals to the gate lines GL. In one embodiment, the gate driver 300 may sequentially output the gate signals to the gate lines GL. The gate driver 300 may be mounted on the display panel 100 or integrated on the display panel 100.

The gamma reference voltage generator 400 generates a gamma reference voltage VGREF in response to the third control signal CONT3 that is received from the driving controller 200. The gamma reference voltage generator 400 provides the gamma reference voltage VGREF to the data driver 500. The gamma reference voltage VGREF may have a value corresponding to a level of the data signal DATA.

In an example embodiment, the gamma reference voltage generator 400 may be disposed in the driving controller 200 or in the data driver 500.

The data driver 500 receives the second control signal CONT2 and the data signal DATA from the driving controller 200 and receives the gamma reference voltage VGREF from the gamma reference voltage generator 400. The data driver 500 converts the data signal DATA into data voltages having an analog type using the gamma reference voltage VGREF. The data driver 500 outputs the data voltages to the data lines DL.

Figure 2:
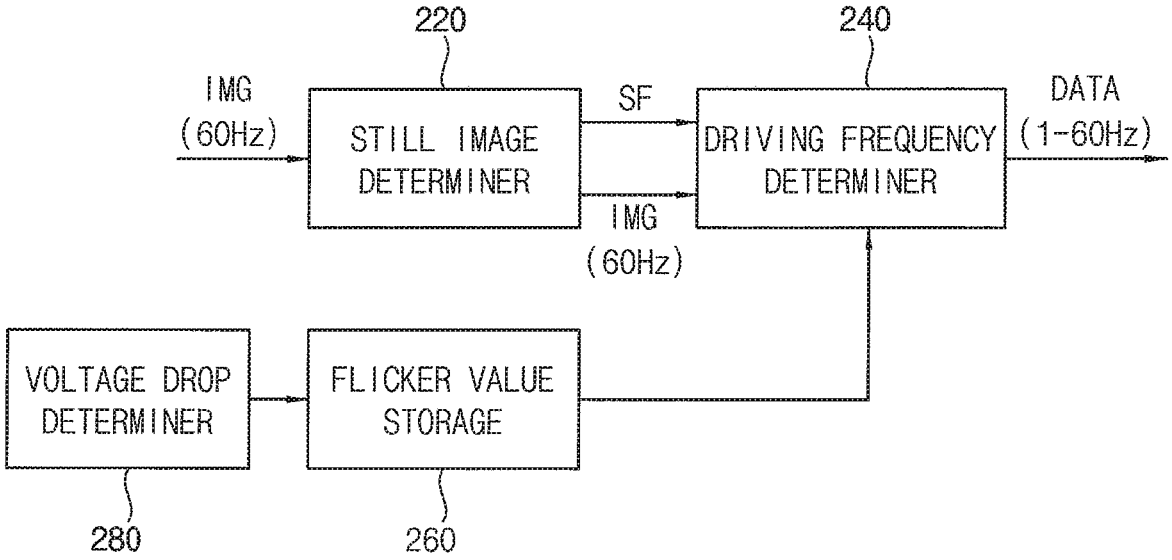
FIG. 2 is a block diagram of a driving controller of FIG. 1 according to an example embodiment of the present inventive concept.
Figure 3:
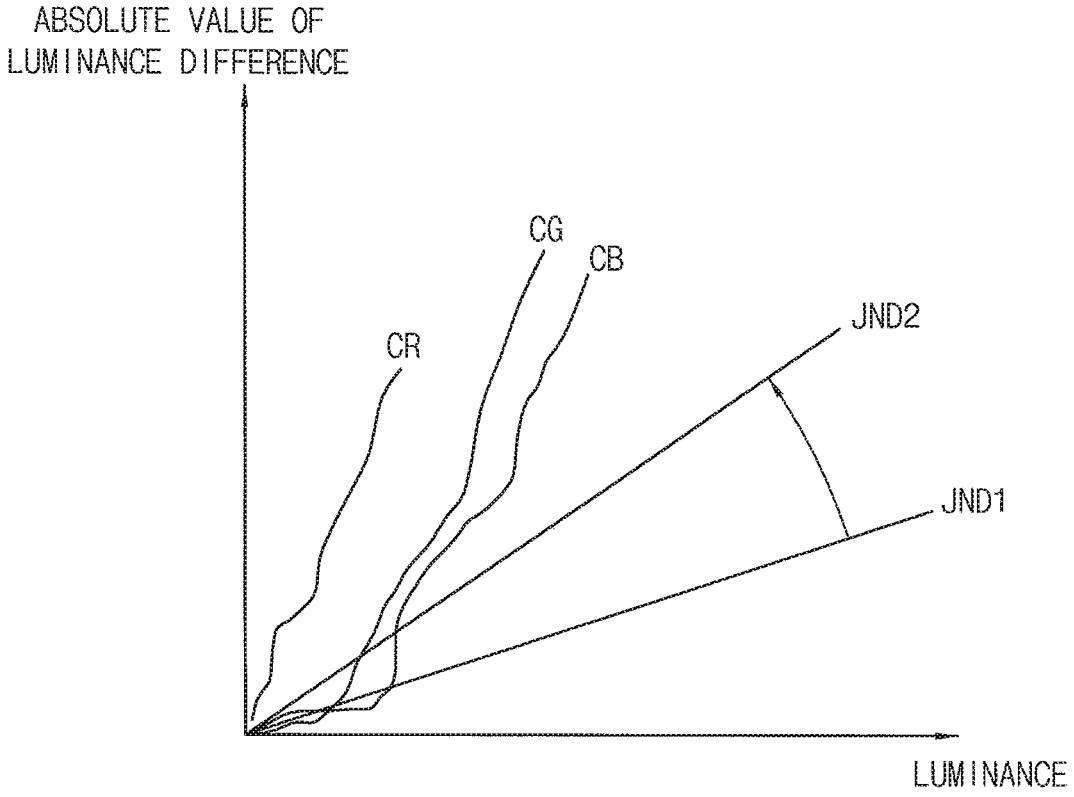
FIG. 3 is a graph illustrating a just-noticeable difference of a user.

FIG. 2 is a block diagram of the driving controller 200 of FIG. 1 according to an example embodiment of the present inventive concept. FIG. 3 is a graph illustrating a just-noticeable difference of a user. FIG. 4 is a table of an exemplary flicker value storage of FIG. 2. FIG. 5 is a table of an exemplary flicker value storage of FIG. 2. FIG. 6 is a table of an exemplary flicker value storage of FIG. 2.

The driving controller 200 may include a still image determiner 220, a driving frequency determiner 240, and a flicker value storage 260. The driving controller 200 may further include a voltage drop determiner 280.

The still image determiner 220 may determine whether the input image data IMG is a still image or a video image. The still image determiner 220 may output a flag SF indicating whether the input image data IMG is the still image or the video image to the driving frequency determiner 240. For example, when the input image data IMG is the still image, the still image determiner 220 may output the flag SF of 1 to the driving frequency determiner 240, and when the input image data IMG is the video image, the still image determiner 220 may output the flag SF of 0 to the driving frequency determiner 240. If the display panel 100 operates in an always-on mode, the still image determiner 220 may output the flag SF of 1 to the driving frequency determiner 240.

When the flag SF is 1, the driving frequency determiner 240 may drive the switching elements in the pixel in a low driving frequency mode.

When the flag SF is 0, the driving frequency determiner 240 may drive the switching elements in the pixel in a normal driving frequency mode.

The driving frequency determiner 240 may refer the flicker value storage 260 to determine the low driving frequency. The flicker value storage 260 may include a flicker value representing a degree of a flicker according to a grayscale value of the input image data IMG.

The flicker value storage 260 may store the grayscale value of the input image data IMG and the flicker value corresponding to the grayscale value of the input image data IMG. The flicker value may be used for determining the driving frequency of the display panel 100. For example, the flicker value storage 260 may include a lookup table.

The flicker value may be set based on a just-noticeable difference of a user for the luminance. The just-noticeable difference may represent a luminance difference which can be perceived by an average human. FIG. 3 illustrates a curve CR of an absolute value of luminance difference of a red image, a curve CG of an absolute value of luminance difference of a green image, and a curve CB of an absolute value of luminance difference of a blue image.

The just-noticeable difference may be represented as a slope of the curve of an absolute value of luminance difference according to a luminance. When the just-noticeable difference is determined to a first just-noticeable difference value JND1, the flicker may not be perceived to a user in an area under a line of the first just-noticeable difference value JND1 in FIG. 3.

When the just-noticeable difference is determined to a second just-noticeable difference value JND2, the flicker may not be perceived to a user in an area under a line of the second just-noticeable difference value JND2 in FIG. 3. When the just-noticeable difference is changed from the first just-noticeable difference value JND1 to the second just-noticeable difference value JND2, the user gets more insensitive to the luminance difference. When the just-noticeable difference is changed from the first just-noticeable difference value JND1 to the second just-noticeable difference value JND2, the area where the user does not perceive the flicker may increase, and a low driving grayscale range driven at the low driving frequency may be increased.

As explained above, the flicker value may vary according to the just-noticeable difference.

The voltage drop determiner 280 may adjust the flicker value based on a voltage drop of the display panel 100. For example, the voltage drop may include a drop of a driving voltage of the pixel. For example, the voltage drop may include a drop of the data voltage. When the flicker value is determined only based on the grayscale value of the input image data IMG without considering the voltage drop of the display panel, the flicker may be perceived by a user at a portion of the display panel far from the data driver 500 due to the voltage drop of the display panel. Thus, the voltage drop of the display panel may be considered when determining the driving frequency.

The voltage drop determiner 280 may determine the just-noticeable difference of the user according to the voltage drop of the display panel. In addition, the flicker value may be adjusted according to the just-noticeable difference.

When the voltage drop is great, the voltage drop determiner 280 may set a reference just-noticeable difference to be little. That is, the reference just-noticeable difference may be inversely proportional to the voltage drop. When the just-noticeable difference is little, a size of the low driving grayscale range may be little. The size of the low driving grayscale range may be proportional to the just-noticeable difference.

In contrast, when the voltage drop is little, the voltage drop determiner 280 may set the reference just-noticeable difference to be great. When the just-noticeable difference is great, a size of the low driving grayscale range may be great.

The flicker value storage 260 may include a plurality of flicker lookup tables. FIG. 4 shows a first flicker lookup table stored in the flicker value storage 260. FIG. 5 shows a second flicker lookup table stored in the flicker value storage 260. FIG. 6 shows a third flicker lookup table stored in the flicker value storage 260. As explained above, the first to third flicker lookup tables may be stored in a single memory (e.g. the flicker value storage 260). Alternatively, the first to third flicker lookup tables may be respectively stored in independent memories.

When the voltage drop determiner 280 determines that the reference just-noticeable difference corresponds to a first just-noticeable difference according to the voltage drop of the display panel, the driving frequency determiner 240 may determine the driving frequency using the first flicker lookup table corresponding to the first just-noticeable difference.

When the voltage drop determiner 280 determines that the reference just-noticeable difference corresponds to a second just-noticeable difference according to the voltage drop of the display panel, the driving frequency determiner 240 may determine the driving frequency using the second flicker lookup table corresponding to the second just-noticeable difference. The voltage drop in FIG. 5 may be less than the voltage drop in FIG. 4, and the second just-noticeable difference in FIG. 5 may be greater than the first just-noticeable difference in FIG. 4. Thus, the size of the low driving grayscale range in FIG. 5 may be greater than the size of the low driving grayscale range in FIG. 4.

When the voltage drop determiner 280 determines that the reference just-noticeable difference corresponds to a third just-noticeable difference according to the voltage drop of the display panel, the driving frequency determiner 240 may determine the driving frequency using the third flicker lookup table corresponding to the third just-noticeable difference. The voltage drop in FIG. 6 may be less than the voltage drop in FIG. 5, and the third just-noticeable difference in FIG. 6 may be greater than the second just-noticeable difference in FIG. 5. Thus, the size of the low driving grayscale range in FIG. 6 may be greater than the size of the low driving grayscale range in FIG. 5.

In FIGS. 4 to 6, the input grayscale value of the input image data IMG may be 8 bits (i.e., 0 to 255), the minimum grayscale value of the input image data IMG may be 0, and the maximum grayscale value of the input image data IMG may be 255. The number of flicker setting stages of the flicker value storage 260 may be 64. As the number of the flicker setting stages increases, the flicker may be effectively removed but a logic size of the driving controller 200 may increase. Thus, the number of the flicker setting stages may be limited by the logic size of the driving controller 200.

Although the input grayscale value of the input image data IMG is shown to be 8 bits in FIGS. 4 to 6, the present inventive concept may not be limited thereto.

In FIG. 4, the number of the grayscale values of the input image data IMG is 256, and the number of the flicker setting stages is 64, and a single flicker value in the flicker value storage 260 may correspond to four grayscale values. A first flicker setting stage stores the flicker value of 0 for the grayscale values of 0 to 3. The flicker value of 0 may represent the driving frequency of 1 Hz. A second flicker setting stage stores the flicker value of 0 for the grayscale values of 4 to 7. The flicker value of 0 may represent the driving frequency of 1 Hz. A third flicker setting stage stores the flicker value of 40 for the grayscale values of 8 to 11. The flicker value of 40 may represent the driving frequency of 2 Hz. A fourth flicker setting stage stores the flicker value of 80 for the grayscale values of 12 to 15. The flicker value of 80 may represent the driving frequency of 5 Hz. A fifth flicker setting stage stores the flicker value of 120 for the grayscale values of 16 to 19. The flicker value of 120 may represent the driving frequency of 10 Hz. A sixth flicker setting stage stores the flicker value of 160 for the grayscale values of 20 to 23. The flicker value of 160 may represent the driving frequency of 30 Hz. A seventh flicker setting stage stores the flicker value of 200 for the grayscale values of 24 to 27. The flicker value of 200 may represent the driving frequency of 60 Hz. Similarly, each of an eighth flicker setting stage to a sixty first flicker setting stage stores a flicker value and a driving frequency for the corresponding grayscale values. A sixty second flicker setting stage stores the flicker value of 0 for the grayscale values of 244 to 247. The flicker value of 0 may represent the driving frequency of 1 Hz. A sixty third flicker setting stage stores the flicker value of 0 for the grayscale values of 248 to 251. The flicker value of 0 may represent the driving frequency of 1 Hz. A sixty fourth flicker setting stage stores the flicker value of 0 for the grayscale values of 252 to 255. The flicker value of 0 may represent the driving frequency of 1 Hz.

In FIG. 5, the number of the grayscale values of the input image data IMG is 256 and the number of the flicker setting stages is 64, and a single flicker value in the flicker value storage 260 may correspond to four grayscale values. A first flicker setting stage stores the flicker value of 0 for the grayscale values of 0 to 3. The flicker value of 0 may represent the driving frequency of 1 Hz. A second flicker setting stage stores the flicker value of 0 for the grayscale values of 4 to 7. The flicker value of 0 may represent the driving frequency of 1 Hz. A third flicker setting stage stores the flicker value of 0 for the grayscale values of 8 to 11. The flicker value of 0 may represent the driving frequency of 1 Hz. A fourth flicker setting stage stores the flicker value of 40 for the grayscale values of 12 to 15. The flicker value of 40 may represent the driving frequency of 2 Hz. A fifth flicker setting stage stores the flicker value of 80 for the grayscale values of 16 to 19. The flicker value of 80 may represent the driving frequency of 5 Hz. A sixth flicker setting stage stores the flicker value of 120 for the grayscale values of 20 to 23. The flicker value of 120 may represent the driving frequency of 10 Hz. A seventh flicker setting stage stores the flicker value of 160 for the grayscale values of 24 to 27. The flicker value of 160 may represent the driving frequency of 30 Hz. Similarly, each of an eighth flicker setting stage to a sixty first flicker setting stage stores a flicker value and a driving frequency for the corresponding grayscale values. A sixty second flicker setting stage stores the flicker value of 0 for the grayscale values of 244 to 247. The flicker value of 0 may represent the driving frequency of 1 Hz. A sixty third flicker setting stage stores the flicker value of 0 for the grayscale values of 248 to 251. The flicker value of 0 may represent the driving frequency of 1 Hz. A sixty fourth flicker setting stage stores the flicker value of 0 for the grayscale values of 252 to 255. The flicker value of 0 may represent the driving frequency of 1 Hz.

As explained above, the size of the low driving grayscale range in FIG. 5 may be greater than the size of the low driving grayscale range in FIG. 4. When the low driving grayscale range is determined as a grayscale range having a driving frequency equal to less than 10 Hz, the low driving grayscale range in FIG. 4 may be between 0 and 19 whereas the low driving grayscale range in FIG. 5 may be between 0 and 23. When the low driving grayscale range is determined as a grayscale range having a driving frequency equal to less than 1 Hz, the low driving grayscale range in FIG. 4 may be between 0 and 7 whereas the low driving grayscale range in FIG. 5 may be between 0 and 11.

In FIG. 6, the number of the grayscale values of the input image data IMG is 256 and the number of the flicker setting stages is 64, and a single flicker value in the flicker value storage 260 may correspond to four grayscale values. A first flicker setting stage stores the flicker value of 0 for the grayscale values of 0 to 3. The flicker value of 0 may represent the driving frequency of 1 Hz. A second flicker setting stage stores the flicker value of 0 for the grayscale values of 4 to 7. The flicker value of 0 may represent the driving frequency of 1 Hz. A third flicker setting stage stores the flicker value of 0 for the grayscale values of 8 to 11. The flicker value of 0 may represent the driving frequency of 1 Hz. A fourth flicker setting stage stores the flicker value of 0 for the grayscale values of 12 to 15. The flicker value of 0 may represent the driving frequency of 1 Hz. A fifth flicker setting stage stores the flicker value of 40 for the grayscale values of 16 to 19. The flicker value of 40 may represent the driving frequency of 2 Hz. A sixth flicker setting stage stores the flicker value of 80 for the grayscale values of 20 to 23. The flicker value of 80 may represent the driving frequency of 5 Hz. A seventh flicker setting stage stores the flicker value of 120 for the grayscale values of 24 to 27. The flicker value of 120 may represent the driving frequency of 10 Hz. Similarly, each of an eighth flicker setting stage to a sixty first flicker setting stage stores a flicker value and a driving frequency for the corresponding grayscale values. A sixty second flicker setting stage stores the flicker value of 0 for the grayscale values of 244 to 247. The flicker value of 0 may represent the driving frequency of 1 Hz. A sixty third flicker setting stage stores the flicker value of 0 for the grayscale values of 248 to 251. The flicker value of 0 may represent the driving frequency of 1 Hz. A sixty fourth flicker setting stage stores the flicker value of 0 for the grayscale values of 252 to 255. The flicker value of 0 may represent the driving frequency of 1 Hz.

As explained above, the size of the low driving grayscale range in FIG. 6 may be greater than the size of the low driving grayscale range in FIG. 5. When the low driving grayscale range is determined as a grayscale range having a driving frequency equal to less than 10 Hz, the low driving grayscale range in FIG. 5 may be between 0 and 23 whereas the low driving grayscale range in FIG. 6 may be between 0 and 27. When the low driving grayscale range is determined as a grayscale range having a driving frequency equal to less than 1 Hz, the low driving grayscale range in FIG. 5 may be between 0 and 11 whereas the low driving grayscale range in FIG. 6 may be between 0 and 15.

The voltage drop determiner 280 may sense a current flowing through the pixel P or the data line DL to determine a voltage drop corresponding to the pixel P. The voltage drop may vary according to a propagation delay of the data line DL, a pixel structure of the display panel 100, a transmitting line structure of the display panel 100, a process variation of a pixel circuit of the display panel 100, a process variation of the data line DL, and a driving mode of the display panel 100.

The voltage drop determiner 280 may store a value regarding the voltage drop of the display panel during manufacturing and/or inspection of the display apparatus. The voltage drop determiner 280 may determine the value regarding the voltage drop of the display panel as an initial set of values for driving the display apparatus. In addition, the voltage drop determiner 280 may determine the voltage drop of the display panel while operating the display apparatus in real time.

The voltage drop determiner 280 may generate a selection signal to select one of the first flicker lookup table, the second flicker lookup table, and the third flicker lookup table depending on a degree of the voltage drop. The driving frequency determiner 240 may refer one of the first flicker lookup table, the second flicker lookup table, and the third flicker lookup table based on the selection signal. Alternatively, the voltage drop determiner 280 may directly update the flicker value stored in the flicker lookup table depending on the degree of the voltage drop.

Although the flicker value storage 260 stores three flicker lookup tables in the present example embodiment, the present inventive concept is not limited to the number of the flicker lookup tables, and any number of flicker lookup tables may be used without deviating from the scope of the present disclosure.

According to the present example embodiment, a driving frequency of the display apparatus is determined according to the image displayed on the display panel 100 to reduce power consumption of the display apparatus. In addition, the driving frequency may be determined using the flicker value of the image on the display panel 100 to prevent the flicker of the image and enhance the display quality of the display panel 100. In addition, the display apparatus includes the voltage drop determiner 280 for adjusting the flicker value based on the voltage drop of the display panel.

Figure 7:
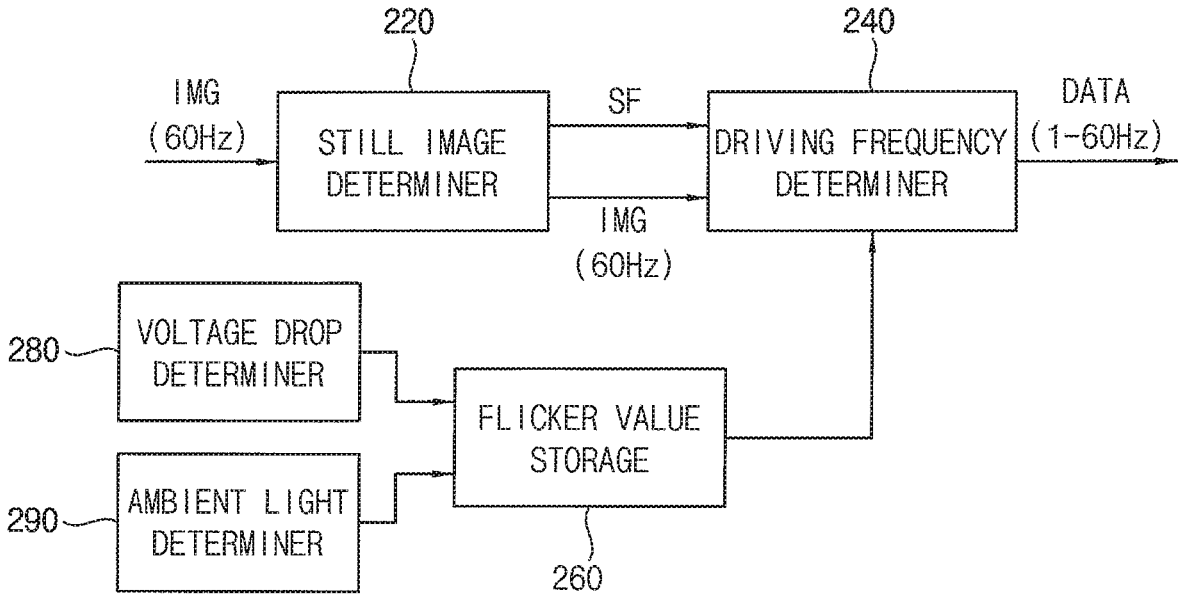
FIG. 7 is a block diagram of a driving controller of a display apparatus according to an example embodiment of the present inventive concept.

FIG. 7 is a block diagram of the driving controller 200 of a display apparatus according to an example embodiment of the present inventive concept.

The display apparatus and the method of driving the display panel according to the present example embodiment is substantially the same as the display apparatus and the method of driving the display panel of the previous example embodiment explained with reference to FIGS. 1 to 6 except for the structure of the driving controller 200. Thus, the same reference numerals will be used to refer to the same or like parts as those described in the previous example embodiment of FIGS. 1 to 6, and any repetitive explanation concerning the above elements will be omitted.

The driving controller 200 may include the still image determiner 220, the driving frequency determiner 240, and the flicker value storage 260. The driving controller 200 may further include the voltage drop determiner 280. In the present example embodiment, the driving controller 200 may further include an ambient light determiner 290. Although the ambient light determiner 290 is shown to be included in the driving controller 200 in the present example embodiment, the present inventive concept may not be limited thereto. For example, the ambient light determiner 290 may be disposed external to the driving controller 200.

The ambient light determiner 290 may adjust the flicker value based on an intensity of an ambient light of the display apparatus.

The ambient light determiner 290 may determine the just-noticeable difference according to the intensity of the ambient light. In addition, the flicker value may be adjusted according to the just-noticeable difference determined by the ambient light determiner 290.

When the intensity of the ambient light is great, the ambient light determiner 290 may set a reference just-noticeable difference to be great. That is, the reference just-noticeable difference may be proportional to the ambient light. When the just-noticeable difference is great, a size of the low driving grayscale range may be great. The size of the low driving grayscale range may be proportional to the just-noticeable difference.

In contrast, when the intensity of the ambient light is little, the ambient light determiner 290 may set the reference just-noticeable difference to be little. When the just-noticeable difference is little, the size of the low driving grayscale range may be little.

In the present example embodiment, the flicker value may be adjusted based on the just-noticeable difference of the user according to the voltage drop and the just-noticeable difference of the user according to the intensity of the ambient light.

In one embodiment, the ambient light determiner 290 may receive a data from an external ambient light sensor included in the display apparatus to determine the intensity of the ambient light.

According to the present example embodiment, the display apparatus determines the driving frequency according to the image displayed on the display panel 100 to reduce the power consumption of the display apparatus. In addition, the driving frequency may be determined using the flicker value of the image on the display panel 100 to prevent the flicker of the image and enhance the display quality of the display panel 100. In addition, the display apparatus includes the voltage drop determiner 280 for adjusting the flicker value based on the voltage drop of the display panel and the ambient light determiner 290 for adjusting the flicker value based on the intensity of the ambient light.

Figure 8:
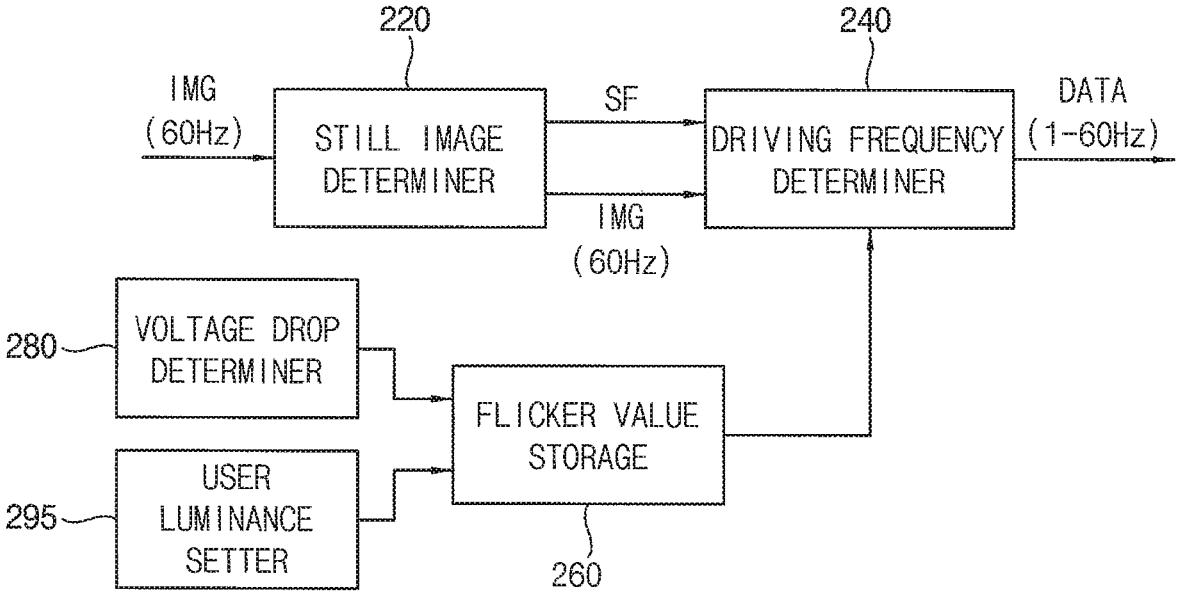
FIG. 8 is a block diagram of a driving controller of a display apparatus according to an example embodiment of the present inventive concept.

FIG. 8 is a block diagram of the driving controller 200 of a display apparatus according to an example embodiment of the present inventive concept.

The display apparatus and the method of driving the display panel according to the present example embodiment is substantially the same as the display apparatus and the method of driving the display panel of the previous example embodiment explained with reference to FIGS. 1 to 6 except for the structure of the driving controller 200. Thus, the same reference numerals will be used to refer to the same or like parts as those described in the previous example embodiment of FIGS. 1 to 6, and any repetitive explanation concerning the above elements will be omitted.

The driving controller 200 may include the still image determiner 220, the driving frequency determiner 240, and the flicker value storage 260. The driving controller 200 may further include a voltage drop determiner 280 and a user luminance setter 295. Although the user luminance setter 295 is shown to be included in the driving controller 200 in the present example embodiment, the present inventive concept may not be limited thereto. For example, the user luminance setter 295 may be disposed external to the driving controller 200.

The user luminance setter 295 may adjust the flicker value based on a user luminance setting value. The user luminance setting value may be set by an input device such as a finger of the user, a touch pen, a keyboard, and a mouse. The user luminance setting value may represent a setting of a maximum luminance limit of the display panel 100.

The user luminance setter 295 may determine the just-noticeable difference according to the user luminance setting value. In addition, the flicker value may be adjusted according to the just-noticeable difference determined by the user luminance setter 295.

When the user luminance setting value is great, the user luminance setter 295 may set a reference just-noticeable difference to be little. That is, the reference just-noticeable difference may be inversely proportional to the user luminance setting value. When the just-noticeable difference is little, a size of the low driving grayscale range may be little.

In contrast, when the user luminance setting value is little, the user luminance setter 295 may set the reference just-noticeable difference to be great. When the just-noticeable difference is great, a size of the low driving grayscale range may be great.

In the present example embodiment, the flicker value may be adjusted based on the just-noticeable difference of the user according to the voltage drop and the just-noticeable difference of the user according to the user luminance setting value.

According to the present example embodiment, the display apparatus determines the driving frequency is determined according to the image displayed on the display panel 100 to reduce the power consumption of the display apparatus. In addition, the driving frequency may be determined using the flicker value of the image on the display panel 100 to prevent the flicker of the image and enhance the display quality of the display panel 100. In addition, the display apparatus includes the voltage drop determiner 280 for adjusting the flicker value based on the voltage drop of the display panel and the user luminance setter 295 for adjusting the flicker value based on the user luminance setting value.

Figure 9:
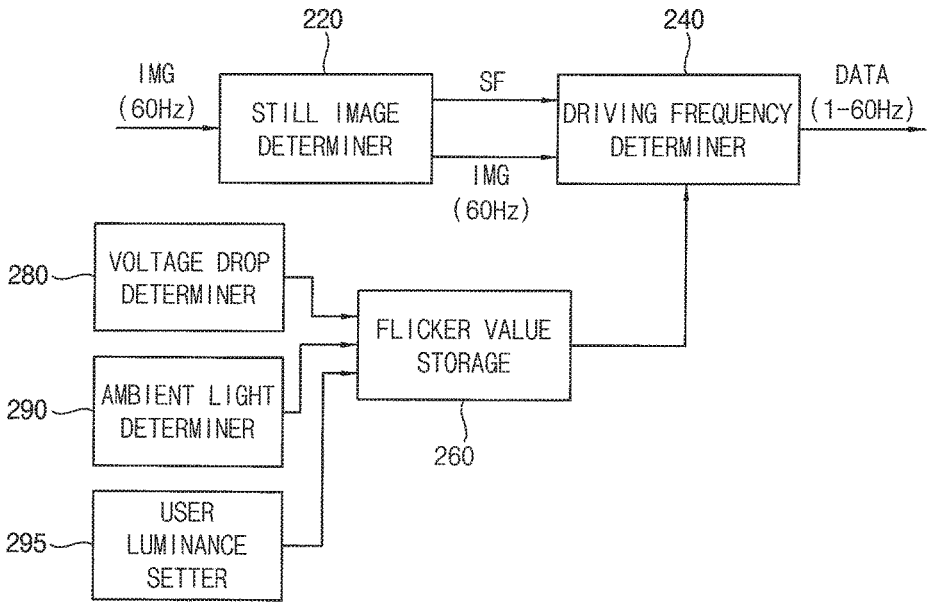
FIG. 9 is a block diagram of a driving controller of a display apparatus according to an example embodiment of the present inventive concept.

FIG. 9 is a block diagram of the driving controller 200 of a display apparatus according to an example embodiment of the present inventive concept.

The display apparatus and the method of driving the display panel according to the present example embodiment is substantially the same as the display apparatus and the method of driving the display panel of the previous example embodiment explained with reference to FIGS. 1 to 6 except for the structure of the driving controller 200. Thus, the same reference numerals will be used to refer to the same or like parts as those described in the previous example embodiment of FIGS. 1 to 6, and any repetitive explanation concerning the above elements will be omitted.

The driving controller 200 may include the still image determiner 220, the driving frequency determiner 240, and the flicker value storage 260. The driving controller 200 may further include the voltage drop determiner 280, the ambient light determiner 290, and the user luminance setter 295. Although the ambient light determiner 290 and the user luminance setter 295 are shown to be included in the driving controller 200 in the present example embodiment, the present inventive concept may not be limited thereto. For example, at least one of the ambient light determiner 290 and the user luminance setter 295 may be disposed external to the driving controller 200.

In the present example embodiment, the flicker value may be adjusted based on the just-noticeable difference of the user according to the voltage drop, the just-noticeable difference of the user according to the intensity of the ambient light, and the just-noticeable difference of the user according to the user luminance setting value.

According to the present example embodiment, the display apparatus determines the driving frequency according to the image displayed on the display panel 100 to reduce the power consumption of the display apparatus. In addition, the driving frequency may be determined using the flicker value of the image on the display panel 100 to prevent the flicker of the image and enhance the display quality of the display panel 100. In addition, the display apparatus includes the voltage drop determiner 280 for adjusting the flicker value based on the voltage drop of the display panel, the ambient light determiner 290 for adjusting the flicker value based on the intensity of the ambient light, and the user luminance setter 295 for adjusting the flicker value based on the user luminance setting value.

Figure 10:
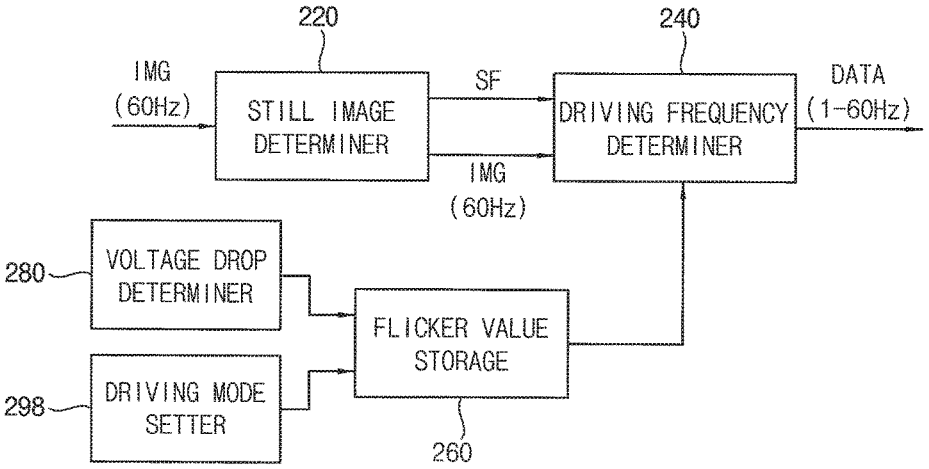
FIG. 10 is a block diagram of a driving controller of a display apparatus according to an example embodiment of the present inventive concept.

FIG. 10 is a block diagram of the driving controller 200 of a display apparatus according to an example embodiment of the present inventive concept.

The display apparatus and the method of driving the display panel according to the present example embodiment is substantially the same as the display apparatus and the method of driving the display panel of the previous example embodiment explained with reference to FIGS. 1 to 6 except for the structure of the driving controller 200. Thus, the same reference numerals will be used to refer to the same or like parts as those described in the previous example embodiment of FIGS. 1 to 6, and any repetitive explanation concerning the above elements will be omitted.

The driving controller 200 may include the still image determiner 220, the driving frequency determiner 240, and the flicker value storage 260. The driving controller 200 may further include the voltage drop determiner 280 and a driving mode setter 298. Although the driving mode setter 298 is shown to be included in the driving controller 200 in the present example embodiment, the present inventive concept may not be limited thereto. For example, the driving mode setter 298 may be disposed external to the driving controller 200.

The driving mode setter 298 may adjust the flicker value based on a driving mode. The driving mode may be automatically set according to the input image data IMG.

According to the driving mode, the luminance of the display image may vary. When the luminance of the display image varies, the just-noticeable difference of the user may vary as well.

The driving mode setter 298 may determine the just-noticeable difference according to the driving mode. In addition, the flicker value may be adjusted according to the just-noticeable difference determined by the driving mode setter 298.

When the luminance (e.g. the maximum luminance of the display image) of the display image is determined to be great according to the driving mode, the driving mode setter 298 may set a reference just-noticeable difference to be little. The reference just-noticeable difference may be inversely proportional to the maximum luminance of the display image. When the just-noticeable difference is little, a size of the low driving grayscale range may be little.

In contrast, when the luminance (e.g. the maximum luminance of the display image) of the display image is determined to be little according to the driving mode, the driving mode setter 298 may set a reference just-noticeable difference to be great. When the just-noticeable difference is great, a size of the low driving grayscale range may be great.

In the present example embodiment, the flicker value may be adjusted based on the just-noticeable difference of the user according to the voltage drop and the just-noticeable difference of the user according to the driving mode.

For example, the driving mode setter 298 may determine whether a high dynamic range (HDR) mode is enabled or not.

When the HDR mode is enabled, the display panel 100 may display a bright portion of the display image to be brighter and a dark portion of the display image to be darker. Thus, when the HDR mode is enabled, the maximum luminance of the display image increases, so that the reference just-noticeable difference may be set to be little. In contrast, when the HDR mode is disabled, the reference just-noticeable difference may be set to be great.

According to the present example embodiment, the display apparatus determines the driving frequency according to the image displayed on the display panel 100 to reduce the power consumption of the display apparatus. In addition, the driving frequency may be determined using the flicker value of the image on the display panel 100 to prevent the flicker of the image and enhance the display quality of the display panel 100. In addition, the display apparatus includes the voltage drop determiner 280 for adjusting the flicker value based on the voltage drop of the display panel and the driving mode setter 298 for adjusting the flicker value based on the driving mode.

Figure 11:
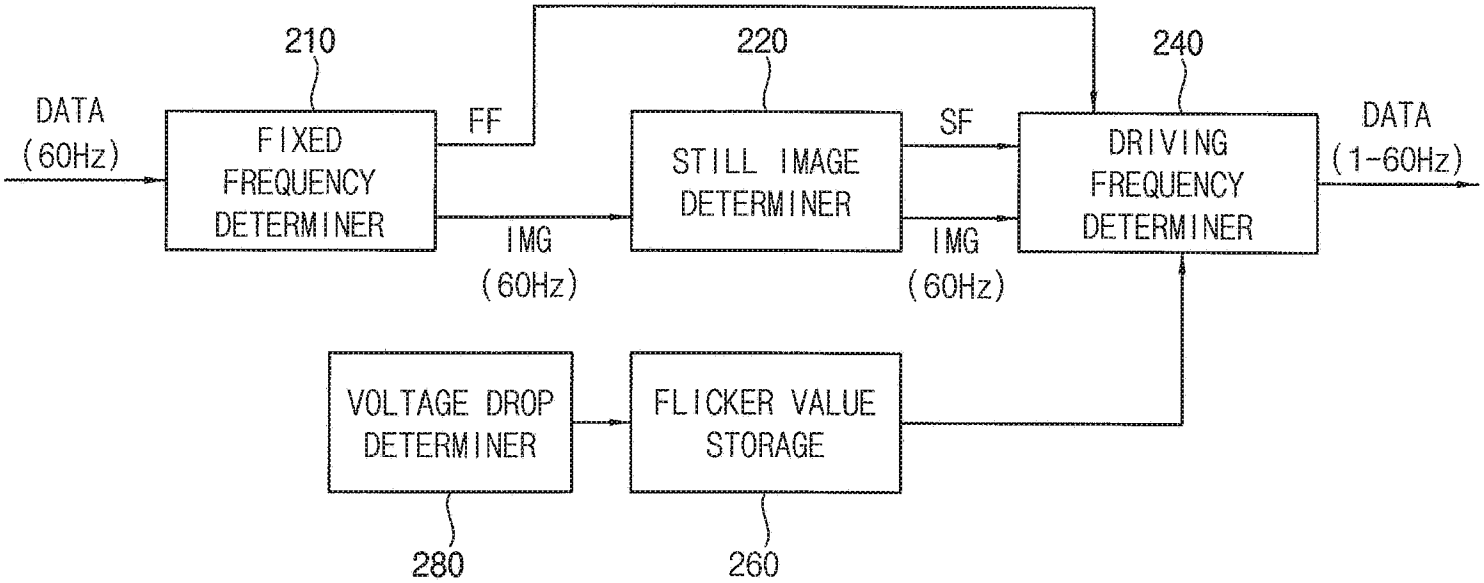
FIG. 11 is a block diagram of a driving controller of a display apparatus according to an example embodiment of the present inventive concept.
Figures 12, 13:
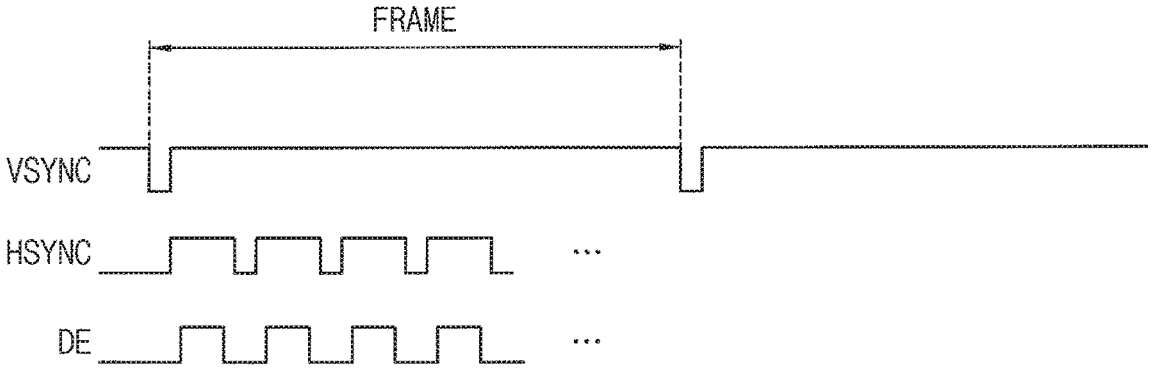
FIG. 12 is a timing diagram of a vertical synchronizing signal, a horizontal synchronizing signal, and a data enable signal in a frame.
FIG. 13 is a conceptual diagram illustrating a display panel of a display apparatus according to an example embodiment of the present inventive concept.

FIG. 11 is a block diagram of the driving controller 200 of a display apparatus according to an example embodiment of the present inventive concept. FIG. 12 is a timing diagram of a vertical synchronizing signal, a horizontal synchronizing signal, and a data enable signal in a frame.

The display apparatus and the method of driving the display panel according to the present example embodiment is substantially the same as the display apparatus and the method of driving the display panel of the previous example embodiment explained with reference to FIGS. 1 to 6 except for the structure of the driving controller 200. Thus, the same reference numerals will be used to refer to the same or like parts as those described in the previous example embodiment of FIGS. 1 to 6, and any repetitive explanation concerning the above elements will be omitted.

The driving controller 200 may include the still image determiner 220, the driving frequency determiner 240, and the flicker value storage 260. The driving controller 200 may further include the voltage drop determiner 280 and a fixed frequency determiner 210. Although the fixed frequency determiner 210 is shown to be included in the driving controller 200 in the present example embodiment, the present inventive concept may not be limited thereto. For example, the fixed frequency determiner 210 may be disposed external to the driving controller 200.

The fixed frequency determiner 210 may determine whether an input frequency of the input image data IMG has a normal type. For example, the fixed frequency determiner 210 may determine whether the input frequency of the input image data IMG has the normal type by counting the number of pulses of a horizontal synchronizing signal HSYNC between a first pulse and a second pulse of a vertical synchronizing signal VSYNC or by counting the number of pulses of a data enable signal DE between the first pulse and the second pulse of the vertical synchronizing signal VSYNC.

A time duration between the first pulse and the second pulse of the vertical synchronizing signal VSYNC may be defined as a frame (or an image frame). When the input frequency of the input image data IMG is 60 Hz, the number of the pulses of the horizontal synchronizing signal HSYNC between the first pulse and the second pulse of the vertical synchronizing signal VSYNC may be equal to or greater than 60. In addition, when the input frequency of the input image data IMG is 60 Hz, the number of the pulses of the data enable signal DE between the first pulse and the second pulse of the vertical synchronizing signal VSYNC may be 60. When the number of the pulses of the data enable signal DE between the first pulse and the second pulse of the vertical synchronizing signal VSYNC is equal to the input frequency of the input image data IMG, the fixed frequency determiner 210 may determine that the input frequency of the input image data IMG has the normal type. In contrast, when the number of the pulses of the data enable signal DE between the first pulse and the second pulse of the vertical synchronizing signal VSYNC is not equal to the input frequency of the input image data IMG, the fixed frequency determiner 210 may determine that the input frequency of the input image data IMG does not have the normal type.

The fixed frequency determiner 210 may generate a frequency flag FF that represents whether the input frequency of the input image data IMG has the normal type or not. The fixed frequency determiner 210 may output the frequency flag FF to the driving frequency determiner 240. The driving frequency determiner 240 may determine the driving frequency of the display panel 100 based on the frequency flag FF. For example, when the input frequency of the input image data IMG does not have the normal type, the driving frequency determiner 240 may drive the switching elements in the pixel P in the normal driving frequency. When the input frequency of the input image data IMG does not have the normal type and the display panel 100 is driven at the low driving frequency, the display panel 100 may generate a display defect. In addition, the still image determiner 220 may not operate when the input frequency of the input image data IMG does not have the normal type, because the driving frequency is fixed to the normal driving frequency when the input frequency of the input image data IMG does not have the normal type.

The still image determiner 220 may determine whether the input image data IMG is a still image or a video image. The still image determiner 220 may output a flag SF that represents whether the input image data IMG is the still image or the video image to the driving frequency determiner 240. For example, when the input image data IMG is the still image, the still image determiner 220 may output the flag SF of 1 to the driving frequency determiner 240. When the input image data IMG is the video image, the still image determiner 220 may output the flag SF of 0 to the driving frequency determiner 240. When the display panel 100 operates in an always-on mode, the still image determiner 220 may output the flag SF of 1 to the driving frequency determiner 240.

When the flag SF is 1, the driving frequency determiner 240 may drive the switching elements in the pixel in the low driving frequency.

When the flag SF is 0, the driving frequency determiner 240 may drive the switching elements in the pixel in the normal driving frequency.

According to the present example embodiment, the display apparatus determines the driving frequency according to the image displayed on the display panel 100 to reduce the power consumption of the display apparatus. In addition, the driving frequency is determined using the flicker value of the image on the display panel 100 to prevent the flicker of the image and enhance the display quality of the display panel 100.

Figure 14:
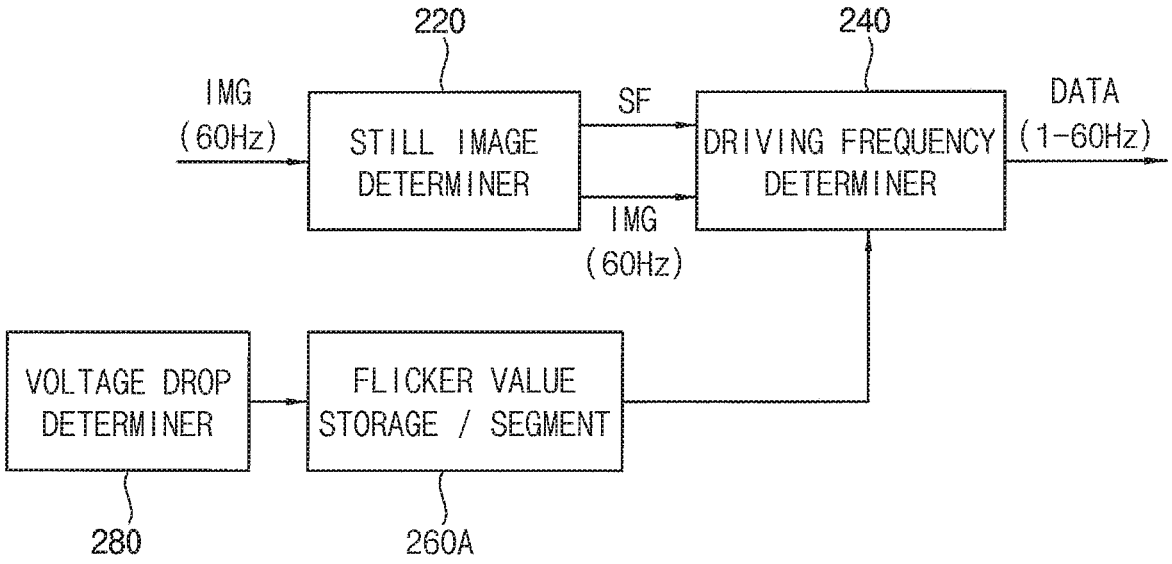
FIG. 14 is a block diagram of a driving controller of the display apparatus of FIG. 13.

FIG. 13 is a conceptual diagram illustrating a display panel 100 of a display apparatus according to an example embodiment of the present inventive concept. FIG. 14 is a block diagram of the driving controller 200 of the display apparatus of FIG. 13.

The display apparatus and the method of driving the display panel according to the present example embodiment is substantially the same as the display apparatus and the method of driving the display panel of the previous example embodiment explained with reference to FIGS. 1 to 6 except that the display panel 100 is divided into a plurality of segments. Thus, the same reference numerals will be used to refer to the same or like parts as those described in the previous example embodiment of FIGS. 1 to 6, and any repetitive explanation concerning the above elements will be omitted.

Referring to FIGS. 1, 3 to 6, 13 and 14, the display apparatus includes the display panel 100 and a display panel driver.

The display panel 100 may include a plurality of segments SEG11 to SEG85. Although the display panel 100 is shown to include the segments in an eight by five matrix in the present example embodiment, the present inventive concept is not limited thereto. The display panel 100 including 40 segments in an eight by five matrix is illustrated for convenience of explanation, but the display panel 100 may include a different number of segments.

The flicker value may be determined for a unit of pixels. In this case, if only one pixel has a high flicker value, the entire display panel may be driven at a high driving frequency to prevent the flicker in the one pixel. For example, when a flicker of only one pixel is prevented in the driving frequency of 30 Hz, and other pixels do not generate the flicker in the driving frequency of 1 Hz, the display panel 100 may be driven at the driving frequency of 30 Hz, and the power consumption of the display apparatus may be higher than necessary.

In one embodiment, the display panel 100 may determine the flicker value for a unit of segments. If only one pixel in a segment has a high flicker value but remaining pixels in the segment has low flicker values, the flicker value of the segment may be determined as an average value of the flicker values in the pixels in the same segment, and the driving frequency of the pixels in the segment may be determined using the average value of the flicker values for the pixels in the segment. For example, in a case where a flicker of a single pixel in the segment can be prevented in the driving frequency of 30 Hz while the other pixels in the segment do not generate the flicker in the driving frequency of 1 Hz, the display panel 100 may be driven at the driving frequency of 1 Hz or 2 Hz based on the average value of the flicker values in the pixels in the segment, which is less than the driving frequency of 30 Hz.

Because the display panel 100 is divided into the segments, and the flicker value is determined for a unit of the segment, the power consumption of the display apparatus may be effectively reduced.

The driving controller 200 may determine optimal driving frequencies for the segments and may determine the maximum driving frequency among the optimal driving frequencies for the segments as the low driving frequency of the display panel 100.

For example, when an optimal driving frequency for a first segment SEG11 is 10 Hz, and optimal driving frequencies for the other segments SEG12 to SEG85 except for the first segment SEG11 are 2 Hz, the driving controller 200 may use the low driving frequency to 10 Hz.

Referring to FIG. 14, the driving controller 200 includes the still image determiner 220, the driving frequency determiner 240, a flicker value storage 260A, and the voltage drop determiner 280.

The driving frequency determiner 240 may refer the flicker value storage 260A and information of the segment of the display panel 100 to determine the low driving frequency.

The flicker value storage 260A may store the grayscale value of the input image data IMG and the flicker value corresponding to the grayscale value of the input image data IMG. The flicker value may be used for determining the driving frequency of the display panel 100. For example, the flicker value storage 260A may include a lookup table.

The voltage drop determiner 280 may adjust the flicker value based on a voltage drop of the display panel 100.

The voltage drop determiner 280 may determine the just-noticeable difference of the user according to the voltage drop of the display panel. In addition, the flicker value may be adjusted according to the just-noticeable difference.

When the voltage drop is great, the voltage drop determiner 280 may set a reference just-noticeable difference to be little. When the just-noticeable difference is little, a size of the low driving grayscale range may be little.

In contrast, when the voltage drop is little, the voltage drop determiner 280 may set the reference just-noticeable difference to be great. When the just-noticeable difference is great, a size of the low driving grayscale range may be great.

According to the present example embodiment, the display panel 100 determines the driving frequency according to the image displayed on the display panel 100 to reduce the power consumption of the display apparatus. In addition, the driving frequency may be determined using the flicker value of the image on the display panel 100 to prevent the flicker of the image and enhance the display quality of the display panel 100. In addition, a high frequency driving grayscale area that is driven at the high driving frequency may be decreased by adjusting the driving frequency based on segments to further reduce the power consumption of the display apparatus while effectively preventing the flicker.

According to the present inventive concept as explained above, the power consumption of the display apparatus may be reduced, and the display quality of the display panel may be enhanced.

The foregoing is illustrative of example embodiments of the present inventive concept and is not to be construed as limiting thereof. Although some example embodiments of the present inventive concept have been described herein, those skilled in the art will readily appreciate that modifications are possible in the example embodiments without materially departing from the novel teachings and advantages of the present inventive concept. Accordingly, such modifications are intended to be included within the scope of the present inventive concept. In the claims, means-plus-function clauses are intended to cover the structures described herein as performing the recited function, not only structural equivalents but also equivalent structures. Some aspects of the present inventive concept may be defined by the following claims, with equivalents of the claims to be included therein.

What is claimed is:

1. A display apparatus comprising:

a display panel comprising a data line and a pixel connected to the data line, and configured to display an image based on an input image data;

a data driver configured to output a data voltage to the data line; and a controller connected to the data driver and configured to control an operation of the data driver, and to determine a driving frequency of the display panel based on the input image data, wherein the controller is further configured to:

store flicker values for grayscale values corresponding to the input image data;

determine a luminance difference according to a voltage drop of the data voltage or a voltage drop of a driving voltage of the display panel;

determine a size of a low driving grayscale range of the grayscale values based on the luminance difference;

adjust a flicker value of the flicker values based on the voltage drop of the data voltage or the voltage drop of the driving voltage of the display panel;

determine whether the input image data is a still image or a video image; and determine the driving frequency of the display panel using the flicker value based on the input image data being the still image.

2. The display apparatus of claim 1, wherein the controller determines that a reference luminance difference corresponds to a first luminance difference according to the voltage drop of the data voltage or the voltage drop of the driving voltage of the display panel and determines the driving frequency using a first flicker lookup table corresponding to the first luminance difference, and wherein the controller further determines that the reference luminance difference corresponds to a second luminance difference according to the voltage drop of the data voltage or the voltage drop of the driving voltage of the display panel and determines the driving frequency using a second flicker lookup table corresponding to the second luminance difference.

3. The display apparatus of claim 1, wherein the controller is further configured to set a reference luminance difference based on the voltage drop of the data voltage or the voltage drop of the driving voltage of the display panel.

4. The display apparatus of claim 1, wherein the voltage drop of the data voltage or the voltage drop of the driving voltage of the display panel is determined by sensing a current flowing through the pixel or a current flowing through the data line.

5. The display apparatus of claim 1, wherein the controller is further configured to adjust the flicker value based on an intensity of an ambient light.

6. The display apparatus of claim 5, wherein controller is further configured to determine the luminance difference according to the intensity of the ambient light, and wherein the controller is further configured to adjust the flicker value according to the luminance difference.

7. The display apparatus of claim 6, wherein the controller is further configured to set a reference luminance difference based on the intensity of the ambient light.

8. The display apparatus of claim 1, wherein the controller is further configured to adjust the flicker value based on a user luminance setting value set by the user.

9. The display apparatus of claim 8, wherein the controller is further configured to determine the luminance difference according to the user luminance setting value, and wherein the controller is further configured to adjust the flicker value according to the luminance difference.

10. The display apparatus of claim 9, wherein the controller is further configured to set a reference luminance difference based on the user luminance setting value.

11. The display apparatus of claim 1, wherein the controller is further configured to determine a type of an input frequency of the input image data by counting a number of pulses of a horizontal synchronizing signal between a first pulse and a second pulse of a vertical synchronizing signal or by counting a number of pulses of a data enable signal between the first pulse and the second pulse of the vertical synchronizing signal.

12. The display apparatus of claim 11, wherein the controller is further configured to generate a frequency flag indicating the type of the input frequency of the input image data and determine the driving frequency of the display panel based on the frequency flag.

13. The display apparatus of claim 1, wherein the display panel comprises a plurality of segments, and wherein the controller is configured to determine the driving frequency of the display panel based on the plurality of segments.

14. The display apparatus of claim 1, wherein the controller is further configured to adjust the flicker value based on a luminance of a display image according to a driving mode.

15. The display apparatus of claim 14, wherein the controller is further configured to determine the luminance difference according to the driving mode, and wherein the controller is further configured to adjust the flicker value according to the luminance difference.

16. The display apparatus of claim 15, wherein the controller is further configured to set a reference luminance difference based on the luminance of the display image according to the driving mode.

17. A method of driving a display panel, the method comprising:

determining whether an input image data is a still image or a video image;

determining a luminance difference based on a voltage drop of a data voltage or a voltage drop of a driving voltage of the display panel;

determining a size of a low driving grayscale range of the grayscale values based on the luminance difference;

determining a driving frequency of the display panel based on flicker values for grayscale values corresponding to the input image data based on the input image data being the still image; and outputting the data voltage to a data line of the display panel based on the driving frequency, wherein a flicker value of the flicker values is adjusted based on the voltage drop of the data voltage or the voltage drop of the driving voltage of the display panel.

18. The method of claim 17, wherein the flicker value is adjusted according to the size of the low driving grayscale range and the voltage drop of the data voltage or the voltage drop of the driving voltage of the display panel.

19. The method of claim 18, wherein a reference luminance difference is determined to correspond to a first luminance difference according to the voltage drop of the data voltage or the voltage drop of the driving voltage of the display panel, and the driving frequency is determined using a first flicker lookup table corresponding to the first luminance difference, and wherein the reference luminance difference is determined to correspond to a second luminance difference according to the voltage drop of the data voltage or the voltage drop of the driving voltage of the display panel, and the driving frequency is determined using a second flicker lookup table corresponding to the second luminance difference.

20. The method of claim 18, wherein a reference luminance difference is set based on the voltage drop of the data voltage or the voltage drop of the driving voltage of the display panel.

21. The method of claim 17, wherein the voltage drop of the data voltage or the voltage drop of the driving voltage of the display panel is determined by sensing a current flowing through a pixel or a current flowing through the data line.

22. The method of claim 17, wherein the flicker value is adjusted based on an intensity of an ambient light or a user luminance setting value.

* * * * *